US010114321B2

(12) United States Patent
Mitsui

(10) Patent No.: US 10,114,321 B2
(45) Date of Patent: Oct. 30, 2018

(54) LUBRICATING DEVICE FOR BELT-SHAPED MEMBER, FIXING DEVICE, AND IMAGE FORMING APPARATUS

(71) Applicant: FUJI XEROX CO., LTD., Tokyo (JP)

(72) Inventor: Taro Mitsui, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/795,262

(22) Filed: Oct. 27, 2017

(65) Prior Publication Data

US 2018/0259888 A1 Sep. 13, 2018

(30) Foreign Application Priority Data

Mar. 7, 2017 (JP) ..... 2017-043004

(51) Int. Cl.
*G03G 15/20* (2006.01)

(52) U.S. Cl.
CPC ..... *G03G 15/2075* (2013.01)

(58) Field of Classification Search
CPC ..... G03G 15/2025; G03G 15/2075
See application file for complete search history.

(56) References Cited

U.S. PATENT DOCUMENTS 8,831,495 B2 * 9/2014 Kim ..... G03G 15/2025 399/328
2008/0317522 A1 * 12/2008 Ardery ..... G03G 15/2025 399/329
2009/0041515 A1 * 2/2009 Kim ..... G03G 15/2025 399/324

FOREIGN PATENT DOCUMENTS

JP 2004354459 12/2004
JP 2009134074 6/2009

* cited by examiner

*Primary Examiner* — Gregory H Curran
(74) *Attorney, Agent, or Firm* — JCIPRNET

(57) ABSTRACT

A lubricating device for a belt-shaped member includes a pair of belt holding members. Each of the belt holding members has a corresponding one of outer peripheral surfaces, is disposed at a corresponding one of end portions of the belt-shaped member in an axial direction of the belt-shaped member, and holds the belt-shaped member. The lubricating device has first grooves and second grooves. Each of the first groove extends in a peripheral direction in the outer peripheral surface of a corresponding one of the belt holding members and holds a liquid lubricant. Each of the second grooves extends in the peripheral direction, is provided at a position in the outer peripheral surface of a corresponding one of the belt holding members further to an outside than the first groove in the axial direction, and holds the liquid lubricant.

9 Claims, 14 Drawing Sheets

LUBRICATING DEVICE FOR BELT-SHAPED MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2017-043004 filed Mar. 7, 2017.

BACKGROUND

Technical Field

The present invention relates to a lubricating device for a belt-shaped member, a fixing device, and an image forming apparatus.

According to an aspect of the present invention, a lubricating device for a belt-shaped member includes a pair of belt holding members. Each of the pair of belt holding members has a corresponding one of outer peripheral surfaces, is disposed at a corresponding one of end portions of the belt-shaped member in an axial direction of the belt-shaped member, and holds the belt-shaped member such that the belt-shaped member is rotatable. The lubricating device has first grooves. Each of the first groove extends in a peripheral direction in the outer peripheral surface of a corresponding one of the pair of belt holding members and holds a liquid lubricant existing on an inner surface of the belt-shaped member. The lubricating device also has second grooves. Each of the second grooves extends in the peripheral direction, is provided at a position in the outer peripheral surface of a corresponding one of the pair of belt holding members further to an outside than the first groove in the axial direction, and holds the liquid lubricant.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below with reference to the drawings.

Exemplary Embodiment

Figure 1:
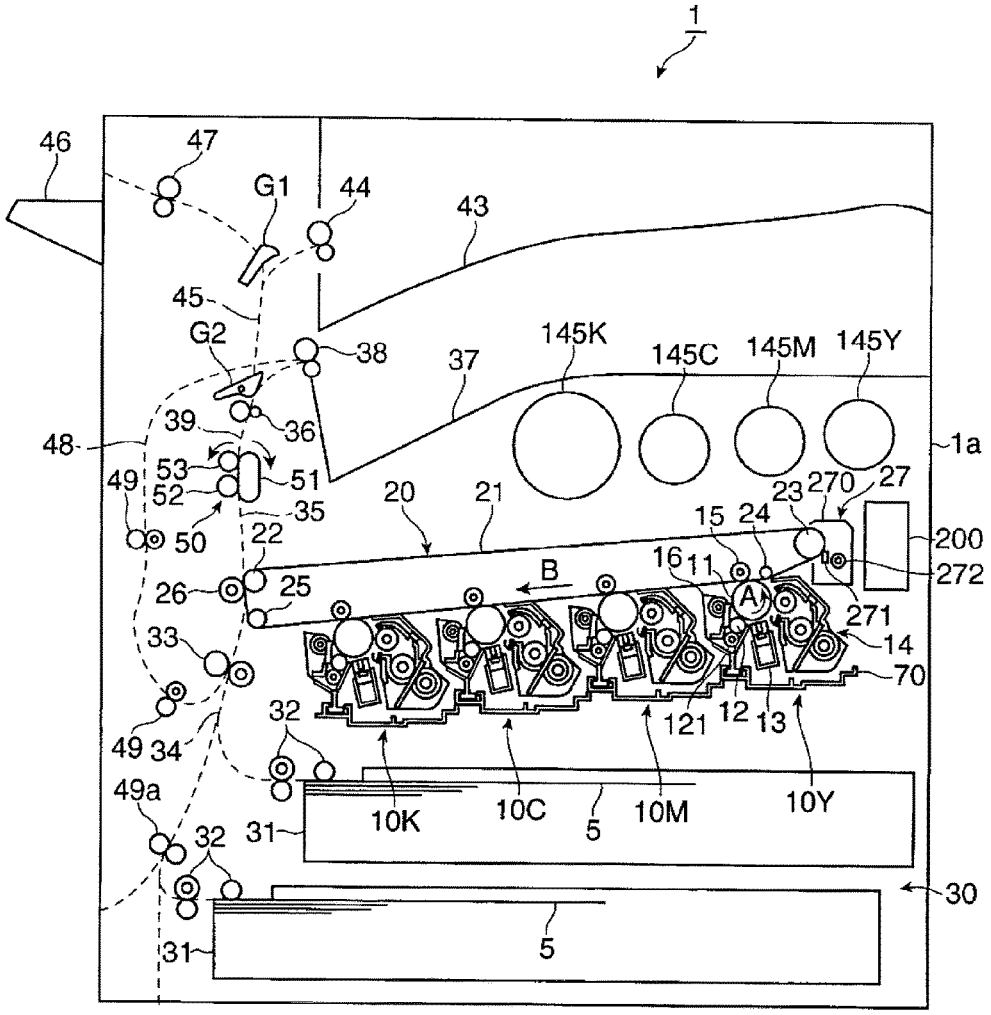
FIG. 1 is a schematic structural view of an image forming apparatus for which a fixing device according to an exemplary embodiment of the present invention is used.
Figure 2:
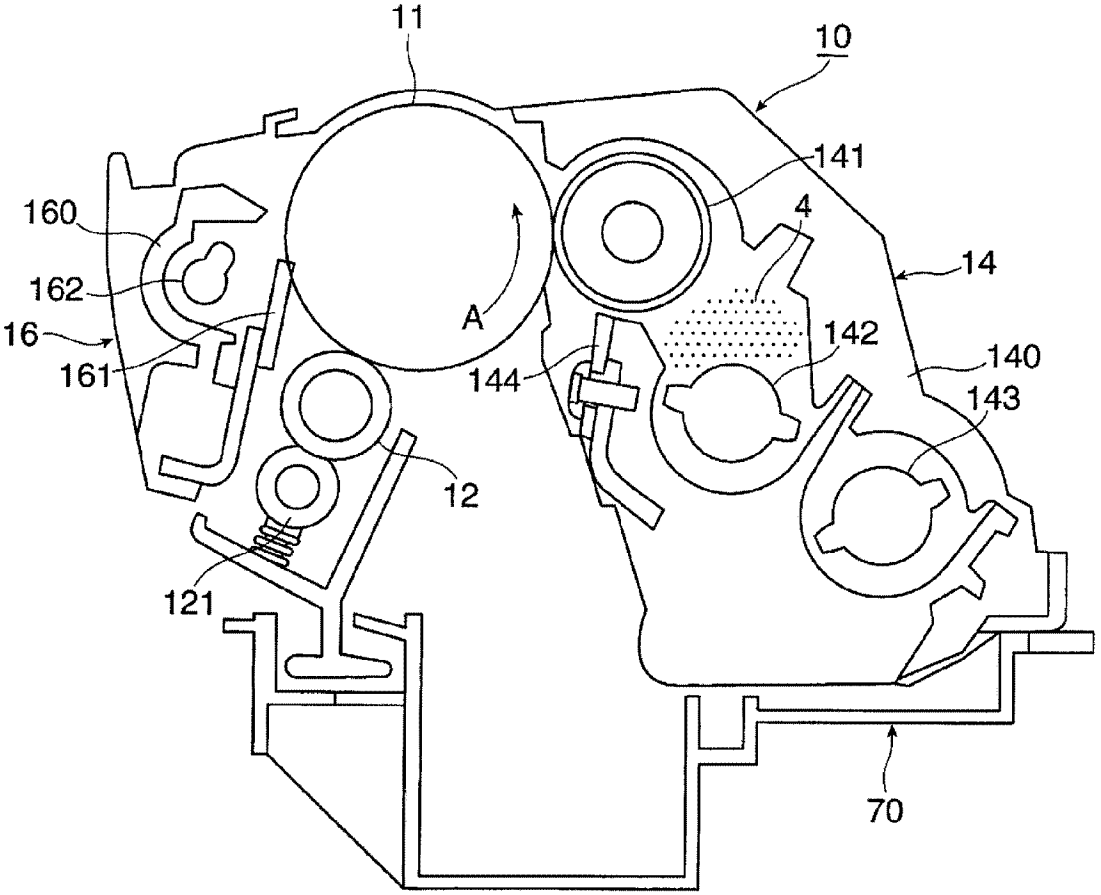
FIG. 2 is a structural view of an image forming unit of the image forming apparatus according to the exemplary embodiment of the present invention.

FIGS. 1 and 2 illustrate an image forming apparatus for which a lubricating device for a belt-shaped member and a fixing device according to an exemplary embodiment are used. FIG. 1 is a schematic overall view of the image forming apparatus, and FIG. 2 is an enlarged view of parts (such as an image forming device) of the image forming apparatus.

Overall Structure of the Image Forming Apparatus

An image forming apparatus 1 according to the exemplary embodiment is configured as a color printer. The image forming apparatus 1 includes plural image forming devices 10, an intermediate transfer device 20, a sheet feed device 30, a fixing device 50, and so forth. The image forming devices 10 form toner images developed with toner included in developer 4. The image forming devices 10 each serve as an example of an image forming unit. The intermediate transfer device 20 holds the toner images having been formed by the image forming devices 10 and transports the toner images to a second transfer position where the toner images are transferred through second transfer onto a recording sheet 5 at last. The recording sheet 5 serves as an example of a recording medium. Also, "recording sheet 5" is described in the plural form "recording sheets 5" where appropriate herein. The sheet feed device 30 contains and transports the required recording sheets 5 to be supplied to the second transfer position of the intermediate transfer device 20. The fixing device 50 fixes the toner images having been transferred through the second transfer by the intermediate transfer device 20 onto the recording sheet 5. Reference sign 1*a* illustrated in the drawings denotes an apparatus body of the image forming apparatus 1. The apparatus body 1*a* includes, for example, support structure members that include plates and so forth and exterior covers. Also in FIG. 1, dotted chain lines indicate transport paths through which each of the recording sheets 5 is typically transported in the image forming apparatus 1.

The image forming devices 10 include four image forming devices 10Y, 10M, 10C, and 10K that each dedicatedly form a toner image of a corresponding one of four colors, that is, yellow (Y), magenta (M), cyan (C), and black (K). These four image forming devices 10, 10M, 10C, and 10K are arranged in an inclined row in an internal space of the apparatus body 1*a*. Out of four image forming devices 10Y, 10M, 10C, and 10K, the yellow (Y) image forming device 10Y is disposed at a relatively high position at an upper position in the vertical direction and the black (K) image forming device 10K is disposed at a relatively lower position in the vertical direction.

As illustrated in FIGS. 1 and 2, each of the four image forming devices 10Y, 10M, 10C, and 10K includes a corresponding one of rotating photosensitive drums 11. The rotating photosensitive drum 11 serves as an example of an image holding body. Devices included in a unit that serves as an example of a toner image forming section are typically disposed around the photosensitive drum 11 as follows. These devices include, for example, a charger 12, a light exposure device 13, a developing device 14Y, 14M, 14C, or 14K, a first transfer device 15Y, 15M, 15C, or 15K, and a drum cleaner 16Y, 16M, 16C, or 16K. The charger 12 charges to a required potential a circumferential surface (image holding surface) of the photosensitive drum 11 on which an image formation is possible. The light exposure device 13 serving as an example of an electrostatic latent image forming unit radiates light in accordance with information (signal) of an image to the charged circumferential surface of the photosensitive drum 11 so as to form an electrostatic latent image (for a corresponding one of the colors) having a potential difference. The developing device 14 serving as an example of a developing section develops the electrostatic latent image with the toner of the developer 4 of a corresponding one of the colors (Y, M, C, and K) so as to form a toner image. The first transfer device 15 serving as an example of a first transfer unit transfers the toner image onto the intermediate transfer device 20. The drum cleaner 16 cleans the photosensitive drum 11 by removing adhering matter such as toner remaining on and adhering to the image holding surface of the photosensitive drum 11 after the first transfer has been performed. In FIG. 1, reference signs for the photosensitive drums 11, the chargers 12, and so forth are indicated only for the yellow (Y) image forming device 10Y and those for the other image forming devices 10M, 10C, 10K are omitted.

The photosensitive drum 11 includes a grounded cylindrical or columnar base member. The image holding surface having a photoconductive layer (photosensitive layer) made of a photosensitive material is formed on the circumferential surface of the base member. This photosensitive drum 11 is supported such that the photosensitive drum 11 is rotated in an arrow A direction by a motive force transmitted from a drive device (not illustrated).

The charger 12 includes a contact-type charging roller disposed so as to be in contact with the photosensitive drum 11. The charger 12 also includes a cleaning roller 121 that cleans a surface of the charger 12. A charging voltage is supplied to the charger 12. In the case where the developing device 14 performs reversal development, a voltage or a current the polarity of which is the same as that of the toner supplied from this developing device 14 is supplied as the charging voltage.

The light exposure device 13 includes a light-emitting-diode (LED) print head. The LED print head includes plural LEDs as light emitting elements arranged in the axial direction of the photosensitive drum 11 so as to radiate the light in accordance with image information to the photosensitive drum 11, thereby forming the electrostatic latent image. Alternatively, the light exposure device 13 may use laser light formed in accordance with the image information to perform deflection scanning in the axial direction of the photosensitive drum 11.

As illustrated in FIG. 2, each of the developing devices 14Y, 14M, 14C, and 14K includes, for example, a developing roller 141, two agitating and transport members 142 and 143, and a layer-thickness regulating member 144. These components are disposed in a housing 140 that has an opening and container chamber for the developer 4. The developing roller 141 holds the developer 4 and transports the developer 4 to a developing region facing the photosensitive drum 11. The agitating and transport members 142 and 143 include two screw augers or the like and transport the developer 4 while agitating the developer 4 so that the developer 4 passes through the developing roller 141. The layer-thickness regulating member 144 regulates the amount (layer thickness) of the developer 4 held by the developing roller 141. A developing bias voltage is supplied between the developing roller 141 and the photosensitive drum 11 of the developing device 14 from a power unit (not illustrated). Furthermore, each of the developing roller 141 and the agitating and transport members 142 and 143 is rotated in a required direction by a motive force transmitted from drive device (not illustrated). Furthermore, two-component developer that includes non-magnetic toner and magnetic carrier is used as the developer 4 of each of the four colors (Y, M, C, or K).

Each of the first transfer devices 15Y, 15M, 15C, and 15K is a contact-type transfer device that includes a first transfer roller. The first transfer roller is in contact with a circumference of the photosensitive drum 11 through an intermediate transfer belt 21 so as to be rotated. A first transfer voltage is supplied to the first transfer roller. As the first transfer voltage, a direct-current voltage the polarity of which is opposite to the polarity to which the toner is charged is supplied from a power unit (not illustrated).

As illustrated in FIG. 2, each of the drum cleaners 16 includes, for example, a body 160, a cleaning plate 161, and a feed member 162. The body 160 has a container shape and is partially opened. The cleaning plate 161 is disposed so as to be in contact at a required pressure with the circumferential surface of the photosensitive drum 11 having undergone the first transfer, thereby cleaning the circumferential surface of the photosensitive drum 11 by removing adhering matter such as residual toner. The feed member 162 that includes a screw auger or the like collects the adhering matter such as toner removed by the cleaning plate 161 and transports the adhering matter so as to feed the adhering matter to a collection system (not illustrated). A plate-shaped member (for example, blade) formed of, for example, rubber is used as the cleaning plate 161.

As illustrated in FIG. 1, the intermediate transfer device 20 is disposed above the image forming devices 10Y, 10M, 10C, and 10K. The intermediate transfer device 20 includes, for example, the intermediate transfer belt 21, plural belt support rollers 22 to 25, a second transfer device 26, and a belt cleaner 27. The intermediate transfer belt 21 is rotated in an arrow B direction while passing through first transfer positions between the photosensitive drums 11 and the first transfer devices 15 (first transfer rollers). The intermediate transfer belt 21 is held in a desired state and rotatably supported from the inner circumferential side by the plural belt support rollers 22 to 25. The second transfer device 26 serving as an example of a second transfer unit is disposed on the outer circumferential surface (image holding surface) side of the intermediate transfer belt 21 at a position where the intermediate transfer belt 21 is supported by the belt support roller 22. The second transfer device 26 transfers through the second transfer the toner images on the intermediate transfer belt 21 onto the recording sheet 5. The belt cleaner 27 cleans the outer circumferential surface of the intermediate transfer belt 21 by removing adhering matter such as toner or paper dust remaining on and adhering to the outer circumferential surface of the intermediate transfer belt 21 after the intermediate transfer belt 21 has passed through the second transfer device 26.

The intermediate transfer belt 21 is an endless belt formed of a material including, for example, synthetic resin such as polyimide resin or polyamide resin in which a resistance adjuster or the like such as carbon black is dispersed. The belt support roller 22 serves as a rear surface support roller for the second transfer. The belt support roller 23 serves as a drive roller rotated by a drive device (not illustrated). The belt support roller 24 serves as a surface forming roller that forms an image forming surface of the intermediate transfer belt 21. The belt support roller 25 serves as a tension applying roller that applies tension to the intermediate transfer belt 21.

As illustrated in FIG. 1, the second transfer device 26 is a contact-type transfer device that includes a second transfer roller that is in contact with the circumferential surface of the intermediate transfer belt 21 so as to be rotated at the second transfer position which is part of the outer circumferential surface of the intermediate transfer belt 21 where the intermediate transfer belt 21 is supported by the belt support roller 22 of the intermediate transfer device 20. A second transfer voltage is supplied to the second transfer roller at the second transfer position. As the second transfer voltage, a direct-current voltage is supplied from a power unit (not illustrated) to the second transfer device 26 or the belt support roller 22 of the intermediate transfer device 20. The polarity of this direct-current voltage is opposite to or the same as the polarity to which the toner is charged.

As illustrated in FIG. 1, the belt cleaner 27 includes, for example, a body 270, a cleaning plate 271, and a feed member 272. The body 270 has a container shape and is partially opened. The cleaning plate 271 is disposed so as to be in contact at a required pressure with the circumferential surface of the intermediate transfer belt 21 having undergone the second transfer so as to clean the circumferential surface of the intermediate transfer belt 21 by removing the adhering matter such as residual toner. The feed member 272 that includes a screw auger or the like collects the adhering matter such as toner removed by the cleaning plate 271 and transports the adhering matter so as to feed the adhering matter to a collection device (not illustrated). A plate-shaped member (for example, blade) formed of, for example, rubber is used as the cleaning plate 271.

The fixing device 50 for which the lubricating device for the belt-shaped member according to the present exemplary embodiment is used includes, for example, a heating rotating member (heating member) 51 and plural pressure rotating members (pressure members) 52 and 53 which are disposed in a housing (not illustrated) having an entrance and an exit for the recording sheet 5. The heating rotating member 51 is in the form of a roller or a belt, rotated in a direction indicated by an arrow, and heated by a heat source so that the surface temperature of the heating rotating member 51 is maintained at a specified temperature. The pressure rotating members 52 and 53 are each in the form of a belt or a roller and in contact with the heating rotating member 51 substantially in the axial direction of the heating rotating member 51 at respective specified pressures, thereby the pressure rotating members 52 and 53 are rotated. This fixing device 50 has contact portions where the heating rotating member 51 and the pressure rotating members 52 and 53 are in contact with one another. This contact portions each serve as a fixing process portion where the required fixing process (heating and applying pressure) is performed. The structure of the fixing device 50 according to the present exemplary embodiment will be described in detail later.

The sheet feed device 30 is disposed below the image forming devices 10Y, 10M, 10C, and 10K in the vertical direction. This sheet feed device 30 includes, for example, plural (or a single) sheet containers 31 and plural (or a single) feed devices 32. The sheet containers 31 each contain the stacked recording sheets 5 of a size, type, and so forth a user wishes to use. The feed devices 32 each feed one sheet after another from the recording sheets 5 contained in a corresponding one of the sheet containers 31. The sheet container 31 is attached so as to, for example, allow the sheet container 31 to be drawn to the front surface side (side surface facing a user who operates the sheet container 31) of the apparatus body 1*a* using a guide rail (not illustrated). According to the present exemplary embodiment, the front surface of the apparatus body 1*a* is defined as the surface on the front side in a direction perpendicular to the page of, for example, FIG. 1.

Examples of the recording sheets 5 include, for example, plain paper, thin paper such as tracing paper, and overhead projector (OHP) transparencies used for electrophotographic copiers, printers, and so forth. In order to further improve smoothness of image surfaces after fixing, smoothness of the front sides of the recording sheets 5 may be increased as much as possible. For example, coated paper made by coating the front side of plain paper with resin or the like, so-called cardboard such as art paper for printing having a comparatively large basis weight, and the like may also be used.

As illustrated in FIG. 1, a sheet feed transport path 34 is provided in the vertical direction between the sheet feed device 30 and the second transfer device 26 on the left side of the apparatus body 1*a*. The sheet feed transport path 34 is formed by a single or plural sheet transport roller pairs 33 and a transport guide (not illustrated). The recording sheet 5 fed from the sheet feed device 30 is transported to the second transfer position through the sheet feed transport path 34. One of the sheet transport roller pairs 33 disposed at a position immediately upstream of the second transfer position in a sheet transport direction in the sheet feed transport path 34 serves as, for example, rollers that adjust timing at which the recording sheet 5 is transported (registration rollers). Furthermore, a sheet transport path 35 is provided between the second transfer device 26 and the fixing device 50. The recording sheet 5 having undergone the second transfer and fed from the second transfer device 26 is transported to the fixing device 50 through the sheet transport path 35. Furthermore, a first output transport path 39 and a second output transport path 45 are provided near an exit for the recording sheets 5 formed in the image forming apparatus body 1*a*. The first output transport path 39 is provided with a first sheet output roller pair 38 for outputting the recording sheet 5 having undergone fixing and fed from the fixing device 50 by an output roller 36 to a first sheet output section 37 in an upper portion of the image forming apparatus body 1*a*. The second output transport path 45 is provided with a second sheet output roller pair 44 for outputting the recording sheet 5 to a second sheet output section 43 positioned above the first sheet output section 37. The second output transport path 45 is also provided with a third sheet output roller pair 47 for outputting the recording sheet 5 advancing in a direction switched by a first switching gate G1 to a third sheet output section 46 on the left side surface of the image forming apparatus body 1*a*. The third sheet output section 46 includes a so-called face-up tray to which the recording sheet 5 is output with an image side facing upward.

A second switching gate G2 is provided between the fixing device 50 and the first sheet output roller pair 38. The second switching gate G2 switches the sheet transport path. The rotational direction of the first sheet output roller pair 38 is switchable between a forward direction (output direction)

and a reverse direction. In order to form images on both sides of the recording sheet 5, the rotational direction of the first sheet output roller pair 38 is switched from the forward direction (output direction) to the reverse direction after a trailing end of the recording sheet 5 on one side of which an image had been formed has been passed through the second switching gate G2. The transport path of the recording sheet 5 transported in the reverse direction by the first sheet output roller pair 38 is switched by the second switching gate G2, so that this recording sheet 5 is transported to a duplex transport path 48 extending in the substantially vertical direction along the side surface of the apparatus body 1*a*. The duplex transport path 48 is provided with sheet transport roller pairs 49, a transport guide (not illustrated), and so forth. The sheet transport roller pairs 49 transport the inverted recording sheet 5 to the sheet transport roller pair 33. Reference numeral 49*a* denotes a sheet transport roller pair that transports to the sheet transport roller pair 33 the recording sheet 5 fed from a manual feed tray (not illustrated) or the sheet container 31 or the sheet containers 31 disposed below the sheet transport roller pair 49*a*.

Referring to FIG. 1, reference numerals 145Y, 145M, 145C, and 145K denote toner cartridges. The toner cartridges 145 are each disposed in a direction perpendicular to the page of FIG. 1 and contain the developer that includes at least the toner to be supplied to a corresponding one of the developing devices 14Y, 14M, 14C, and 14K. Furthermore, reference numeral 70 of FIG. 1 denotes guide members. Each of the guide members 70 guides a corresponding one of the image forming devices 10Y, 10M, 10C, and 10K for yellow (Y), magenta (M), cyan (C), and black (K) during attachment to or detachment from the apparatus body 1*a*. The image forming devices 10Y, 10M, 10C, and 10K are each configured as a unit.

Furthermore, reference numeral 200 illustrated in FIG. 1 denotes a controller that controls entire operation of the image forming apparatus 1. The controller 200 includes components and so forth (not illustrated) such as a central processing unit (CPU), a read only memory (ROM), a random access memory (RAM), buses through which these CPU, ROM, and so forth are connected, and a communication interface.

Operation of the Image Forming Apparatus

Basic image forming operation performed by the image forming apparatus 1 is described below.

Here, an operation in a full-color mode is described. In the full-color mode, a full-color image is formed by combining the toner images of four colors (Y, M, C, and K) by using four image forming devices 10Y, 10M, 10C, and 10K.

The image forming apparatus 1 is controlled by the controller 200. Upon reception of instruction information requesting a full-color image forming operation (printing) from a user interface (not illustrated), a printer driver (not illustrated), or the like, four image forming devices 10Y, 10M, 10C, and 10K, the intermediate transfer device 20, the second transfer device 26, the fixing device 50, and so forth are started.

Consequently, in the image forming devices 10Y, 10M, 10C, and 10K, as illustrated in FIGS. 1 and 2, first, the photosensitive drums 11 are rotated in the arrow A direction, and the chargers 12 charge the surfaces of the respective photosensitive drums 11 to the required polarity (negative polarity according to the exemplary embodiment) and the required potentials. Next, the light exposure devices 13 radiate the light emitted in accordance with image signals obtained by converting image information input to the image forming apparatus 1 into color components (Y, M, C, and K) to the surfaces of the charged photosensitive drums 11. Thus, the electrostatic latent images for the respective color components having the required potentials are formed on the surfaces of the photosensitive drums 11.

Next, the image forming devices 10Y, 10M, 10C, and 10K each supply the toner of a corresponding one of the colors (Y, M, C, and K) charged to the required polarity (negative polarity) from the developing roller 141 to the electrostatic latent image for the corresponding one of the color components formed on the photosensitive drum 11. Thus, the electrostatic latent image is developed by causing the toner to electrostatically adhere to the photosensitive drum 11. Through this development, the electrostatic latent image for the corresponding one of the color components formed on the photosensitive drum 11 is developed with the toner of the corresponding one of four colors (Y, M, C, and K) and becomes a visual toner image of the color.

Next, when the toner images of the colors formed on the photosensitive drums 11 of the image forming devices 10Y, 10M, 10C, and 10K are transported to the first transfer positions, the first transfer devices 15Y, 15M, 15C, and 15K transfer the toner images of the colors through the first transfer onto the intermediate transfer belt 21 of the intermediate transfer device 20 rotated in the arrow B direction such that the toner images are sequentially superposed on one another.

The drum cleaners 16 clean the surfaces of the photosensitive drums 11 by removing the adhering matter such that the adhering matter is scraped off from the surfaces of the photosensitive drums 11 in the image forming devices 10Y, 10M, 10C, and 10K where the first transfer has been performed. Thus, the image forming devices 10Y, 10M, 10C, and 10K are ready to perform the next image forming operation.

Next, the toner images having been transferred onto the intermediate transfer belt 21 through the first transfer are held by the intermediate transfer belt 21 and transported to the second transfer position by rotating the intermediate transfer belt 21 in the intermediate transfer device 20. Meanwhile, the sheet feed device 30 feeds the required recording sheet 5 to the sheet feed transport path 34 such that the feeding of the recording sheet 5 is adjusted to the image forming operation. The recording sheet 5 is fed and supplied to the second transfer position by the sheet transport roller pair 33 serving as the registration rollers at timing adjusted to timing of the transfer in the sheet feed transport path 34.

The second transfer device 26 collectively transfers the toner images on the intermediate transfer belt 21 onto the recording sheet 5 through the second transfer at the second transfer position. Furthermore, the belt cleaner 27 cleans the surface of the intermediate transfer belt 21 by removing the adhering matter such as the toner remaining on the surface of the intermediate transfer belt 21 after the second transfer has been performed in the intermediate transfer device 20 having undergone the second transfer.

Next, the recording sheet 5 onto which the toner images have been transferred through the second transfer is removed from the intermediate transfer belt 21 and then transported to the fixing device 50 through the sheet transport path 35. In the fixing device 50, the recording sheet 5 having undergone the second transfer is introduced into and passes through the contact portions between the heating rotating member 51 being rotated and the pressure rotating members 52 and 53 being rotated. This causes the recording sheet 5 to be subjected to a required fixing process (heating and applying pressure), thereby the unfixed toner images are fixed onto the recording sheet 5. At last, in the case of the image forming operation where image formation is performed on only one of the sides of the recording sheet 5, the recording sheet 5 having undergone the fixing is output to, for example, the first sheet output section 37 provided in the upper portion of the apparatus body 1*a* by, for example, the first sheet output roller pair 38.

Through the above-described operation, the recording sheet 5 is output on which the full-color image or the full-color images made by combining the toner images of four colors have been formed. Of course, the image forming apparatus 1 may form a monochrome image or monochrome images on the recording sheet 5 only with the black (K) image forming device 10K.

Figure 3:
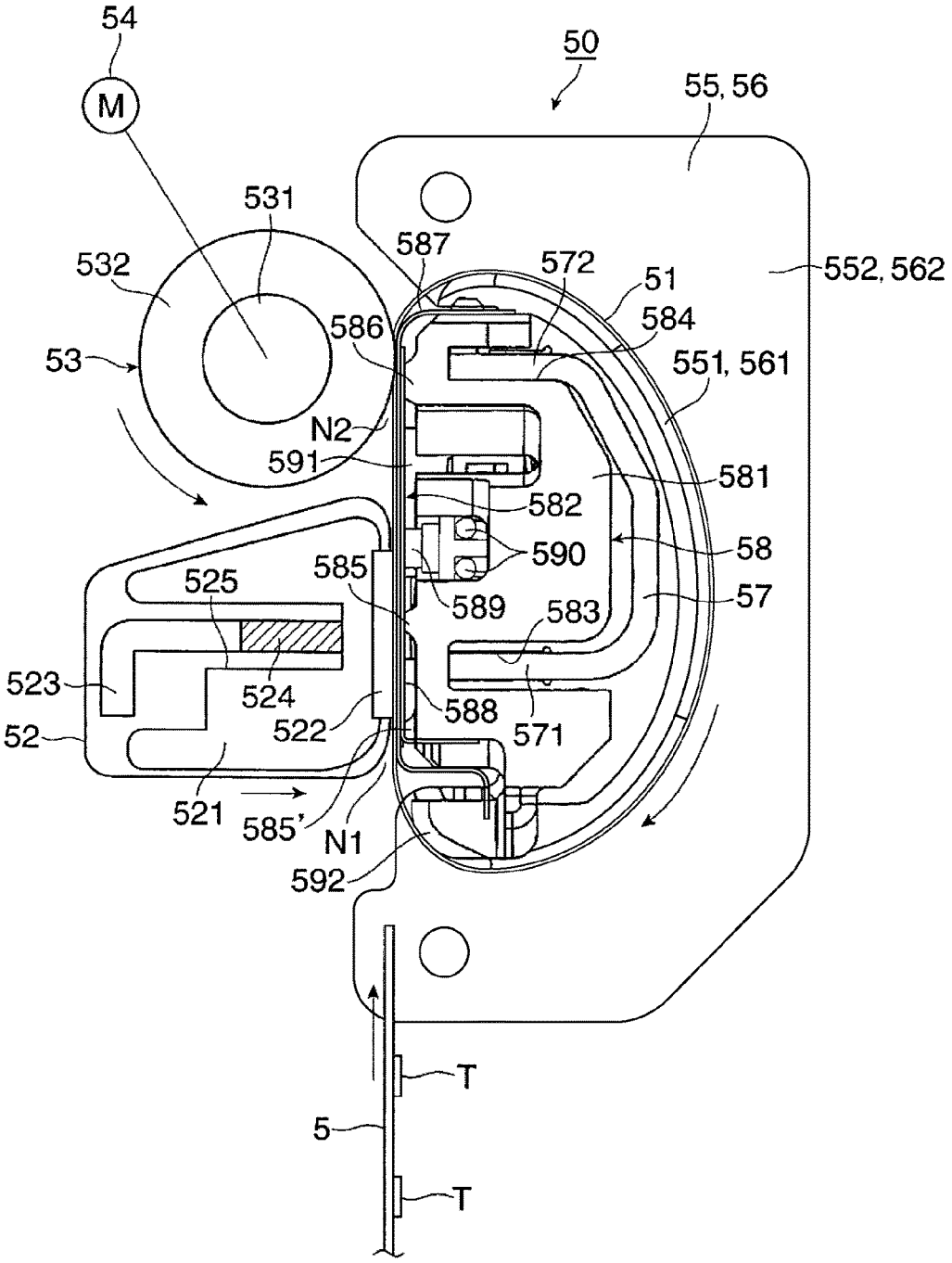
FIG. 3 is a structural sectional view of the fixing device according to the exemplary embodiment of the present invention.
Figure 4:
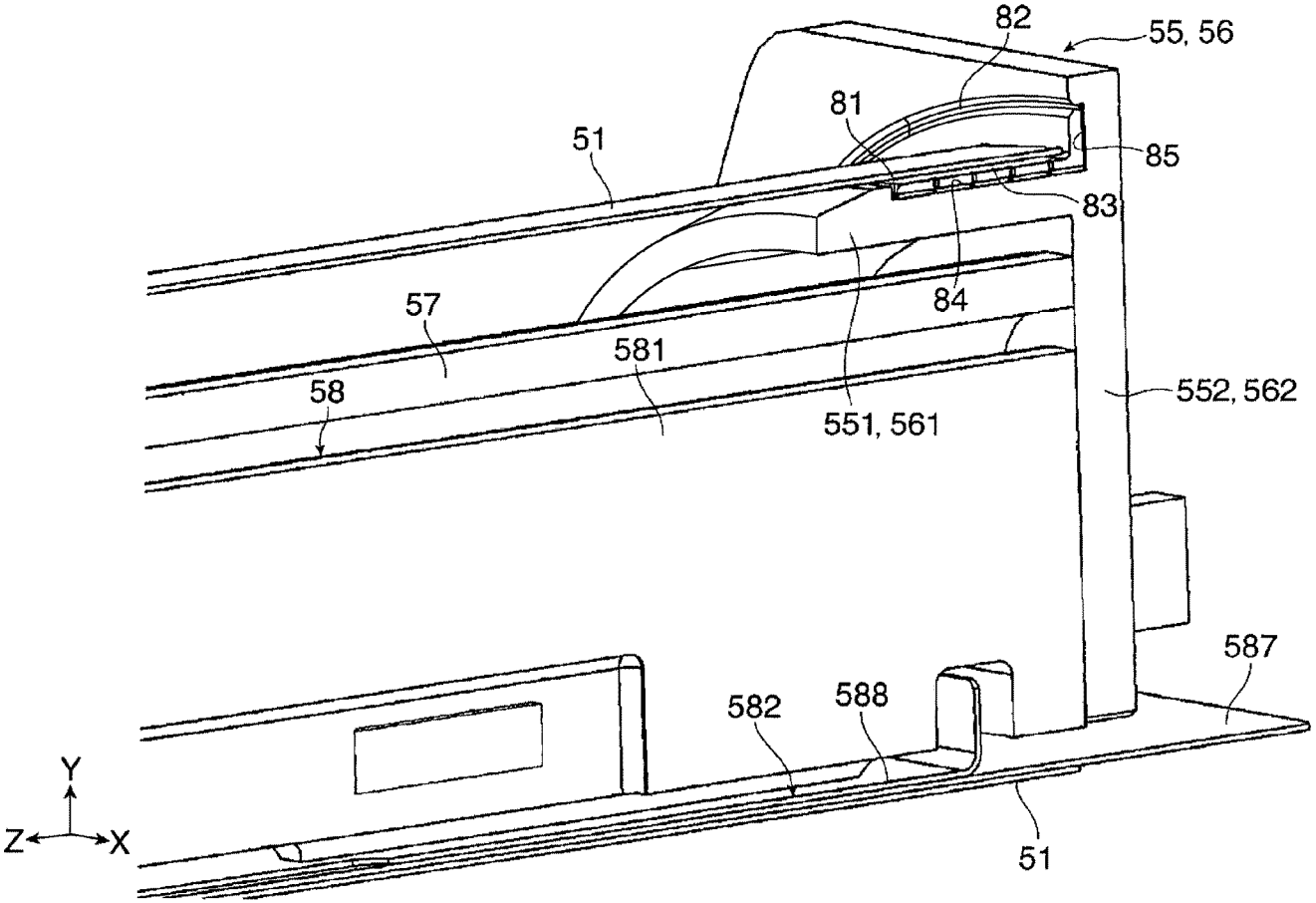
FIG. 4 is a perspective sectional view of part of the fixing device according to the exemplary embodiment of the present invention.

Structures of the Lubricating Device for the Belt-Shaped Member and the Fixing Device FIGS. 3 and 4 illustrate the fixing device for which the lubricating device for the belt-shaped member according to the exemplary embodiment is used. FIG. 3 illustrates the entirety of the fixing device. FIG. 4 illustrates part of this fixing device.

Roughly classified, as illustrated in FIG. 3, the fixing device 50 includes a heating belt 51, a pressure belt 52, and a pressure roller 53. The heating belt 51 that serves as an example of the heating rotating member (heating member) includes a belt-shaped member. The pressure belt 52 and the pressure roller 53 serve as examples of plural pressure rotating members (pressure members) in pressure contact with the heating belt 51. The pressure belt 52 corresponds to a first pressure member and the pressure roller 53 corresponds to a second pressure member. In the fixing device 50, the contact portions where the heating belt 51 is in contact with the pressure belt 52 and the pressure roller 53 serve as fixing process portions (nips) N where the required fixing process (heating and applying pressure) is performed. The fixing device 50 includes plural nips, that is, a first nip N1 and a second nip N2 corresponding to the number of pressure rotating members (two in an example illustrated in FIG. 3).

Figure 5:
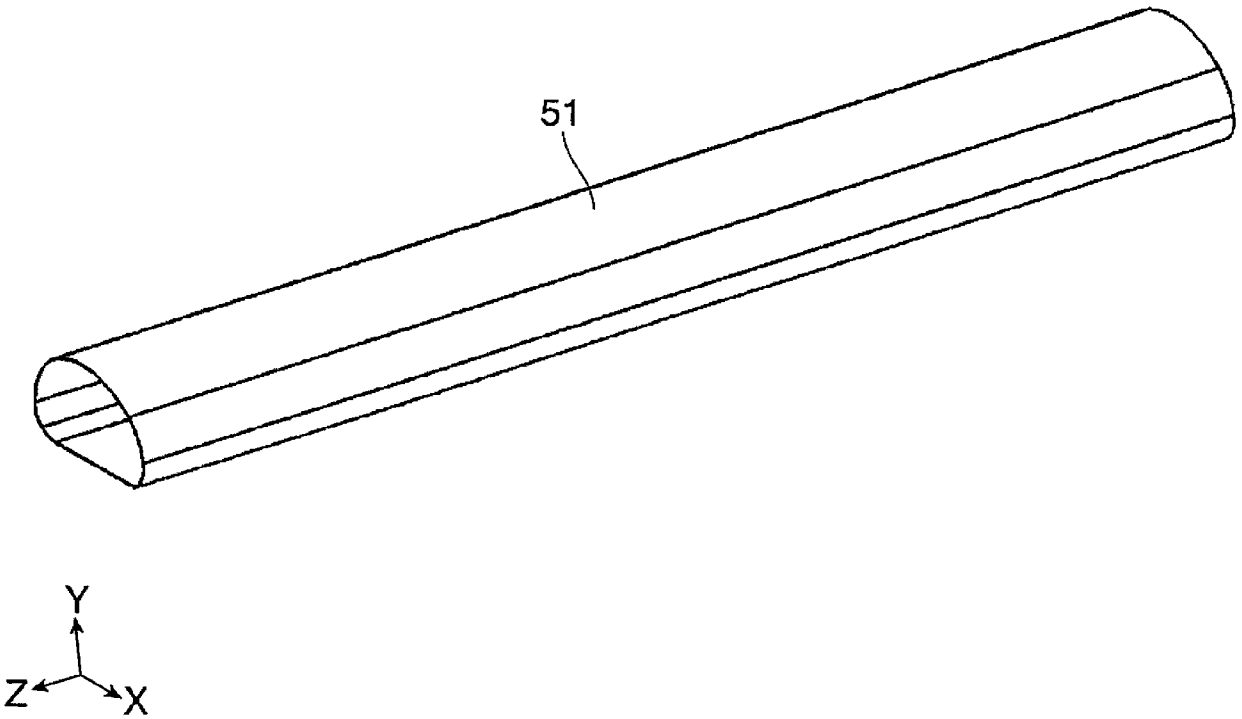
FIG. 5 is a structural perspective view of a heating belt.

Referring to FIG. 5, the heating belt 51 is an endless belt formed of a material including, for example, heat-resistant synthetic resin such as, for example, polyimide resin or polyamide resin in which a resistance adjuster or the like such as carbon black is dispersed according to need. The heating belt 51 is a rotating member moving in a circulating path. For convenience, the shape of the heating belt 51 illustrated in FIG. 5 follows the shape when the heating belt 51 is in use. However, the heating belt 51 has a cylindrical shape in a free state. As illustrated in FIG. 3, the heating belt 51 is rotated by being driven by the pressure roller 53 in accordance with a pressing force of the pressure roller 53, which is rotated by a drive motor 54 serving as a drive source. During fixing, the heating belt 51 is rotated by the pressure roller 53 so as to move in a circulating path at a predetermined fixing speed (for example, at such a speed as 200 to 300 mm/sec).

Compared to a heating roller that is a roller-shaped heating rotating member, the heating belt 51 exhibits considerably small thermal capacity, and accordingly, is heated to a required fixing temperature in a short time period by a heating unit 58, which will be described later. Accordingly, the heating belt 51 is heated to the required fixing temperature and becomes ready for a fixing operation in a short time period from when a start signal for the image forming operation is input.

Figure 6:
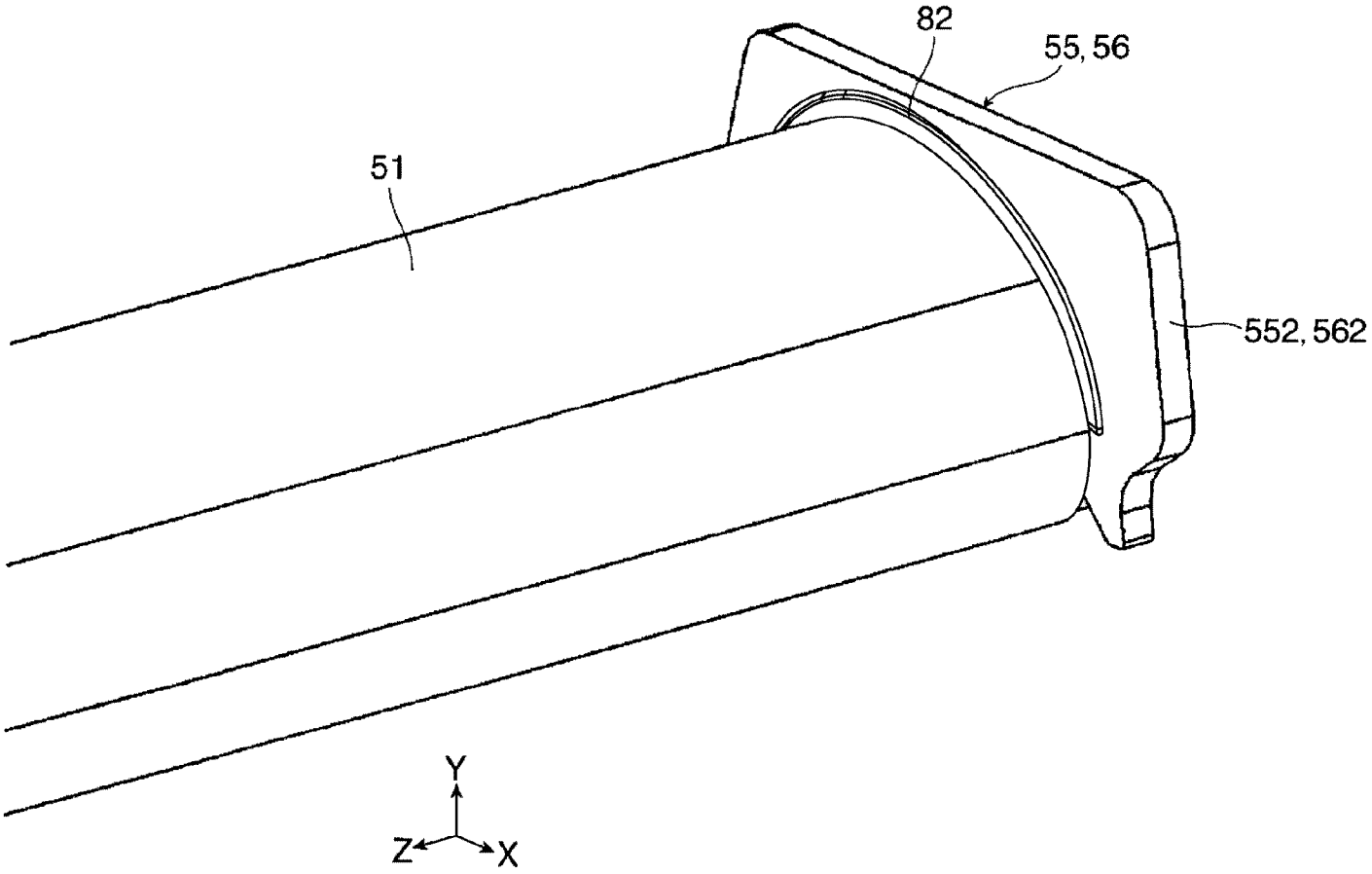
FIG. 6 is a structural perspective view of an end portion of the heating belt.

As illustrated in FIG. 6, the heating belt 51 is rotatably held by a pair of belt-end-portion holding members (belt holding members) 55 and 56. The pair of belt-end-portion holding members 55 and 56 are each disposed at corresponding one of end portions of the heating belt 51 in the axial direction of the heating belt 51 (direction intersecting the moving direction). The pair of belt-end-portion holding members 55 and 56 include holding portions 551 and 561 (see FIG. 3) and flat-plate shaped flange portions 552 and 562. The holding portions 551 and 561 (see FIG. 3) are inserted into a space on the inner circumferential side of the heating belt 51 at the respective end portions of the heating belt 51 and hold the heating belt 51 such that the heating belt 51 is rotatable. The holding portions 551 and 561 each have an outer circumferential surface that forms part of a substantially elliptical shape. Flat-plate shaped flange portions 552 and 562 are integrally formed with the respective holding portions 551 and 561 at end portions of the holding portions 551 and 561 and extend in a direction intersecting the axial direction (radial direction) of the heating belt 51. The pair of belt-end-portion holding members 55 and 56 are attached to a housing (frame; not illustrated) of the fixing device 50 with the flange portions 552 and 562 interposed therebetween. The distance between the flange portions 552 and 562 of the belt-end-portion holding members 55 and 56 is set to be slightly larger than the length of the heating belt 51 in the axial direction. This may suppress damage to the end portions of the heating belt 51 in the axial direction of the heating belt 51 caused by pressure contact of the end portions of the heating belt 51 in the axial direction with the flange portions 552 and 562 of the belt-end-portion holding members 55 and 56 in the fixing device 50.

As illustrated in FIG. 3, a support member 57 and the heating unit 58 are provided in the space on the inner circumferential side of the heating belt 51. The support member 57 supports the pair of belt-end-portion holding members 55 and 56 in a state in which the pair of belt-end-portion holding members 55 and 56 are connected to each other. The heating unit 58 is attached to the support member 57 and heats the heating belt 51 from the inner circumferential side of the heating belt 51.

Figure 7:
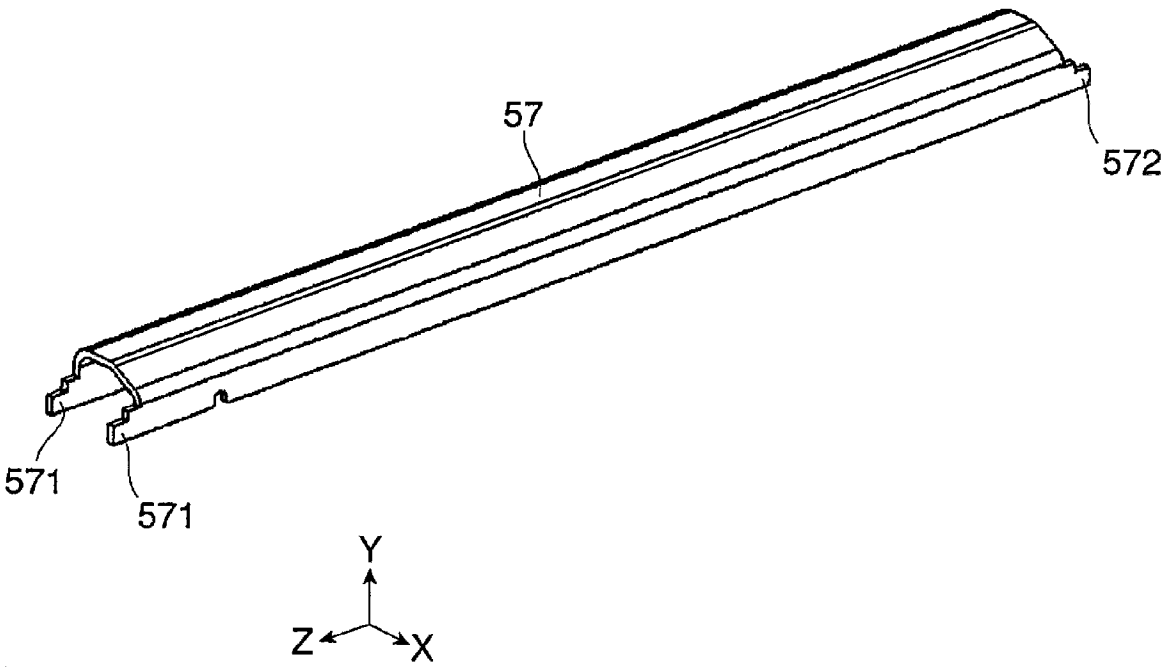
FIG. 7 is a structural perspective view of a support member.

As illustrated in FIG. 7, the support member 57 is formed of metal such as stainless steel or heat-resistant synthetic resin and has a substantially U shape opening at one side (lower side in FIG. 7). The support member 57, which is subjected to pressing forces from the pressure belt 52 and the pressure roller 53, has stiffness. Mount portions 571 and 572 for mounting the belt-end-portion holding members 55 and 56 are provided at both end portions in the longitudinal direction of the support member 57.

Figure 8:
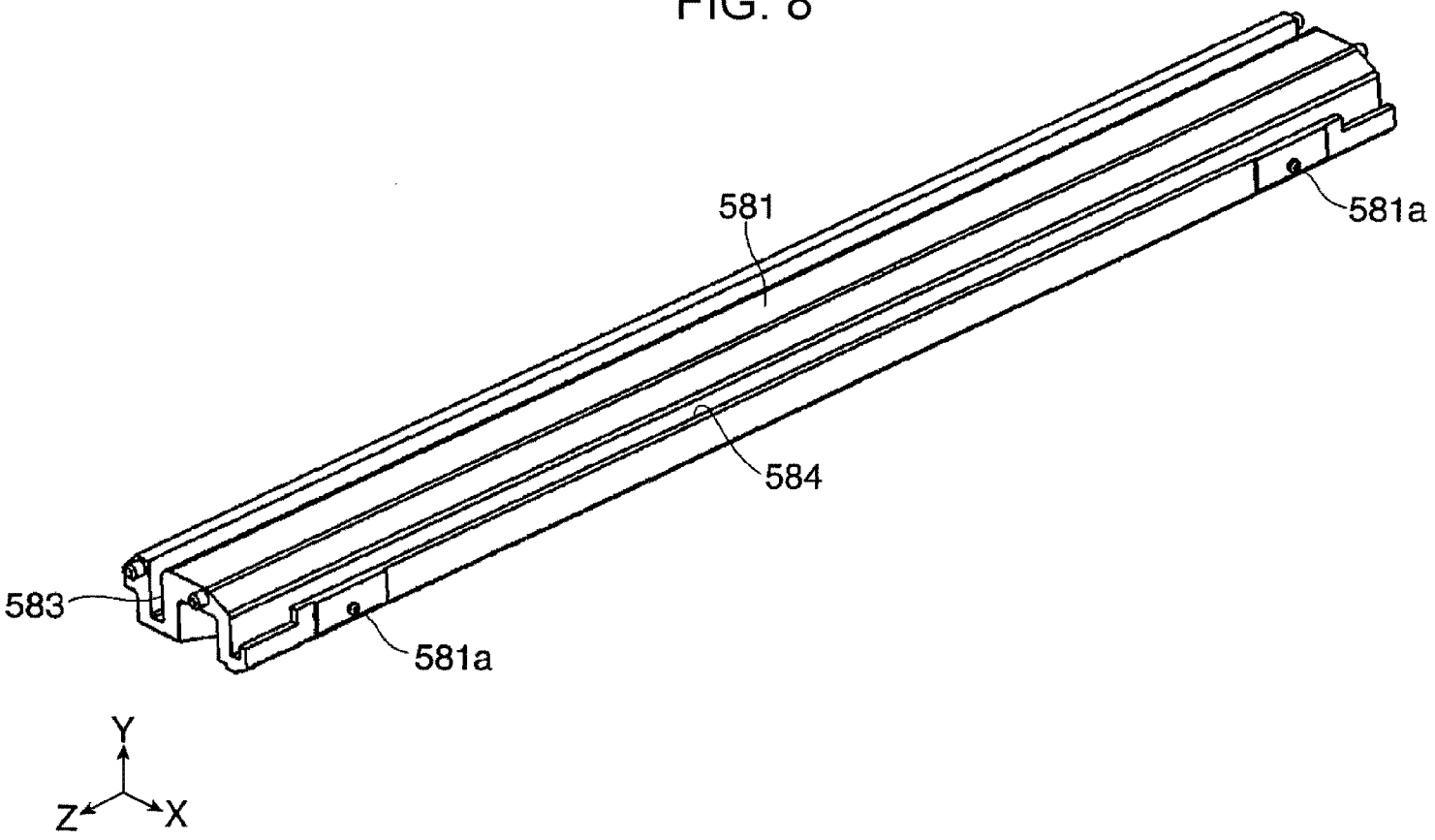
FIG. 8 is a structural perspective view of a heating base material.

As illustrated in FIG. 3, the heating unit 58 includes a heating base material (heating pad) 581 and a heating member 582. The heating base material 581 is a stiff member having a substantially rectangular shape in section and formed of, for example, heat-resistant synthetic resin. The sheet-shaped heating member 582 is attached to a side surface of the heating base material 581 on the pressure side (left side surface in FIG. 3). The heating base material 581 illustrated in FIG. 8 is fitted onto the support member 57 using recesses 583 and 584 or fixedly attached to the support member 57 by, for example, screwing (not illustrated). As illustrated in FIG. 3, the heating base material 581 includes three projections 585, 586, and 586' on the side surface thereof on the nips N1 and N2 side. The projections 585, 586, and 586' extend in the axial direction (longitudinal direction) of the heating belt 51 so as to hold the heating member 582 flat. The first projection 585 disposed on the upstream side in the moving direction of the heating belt 51 is positioned on the downstream side of the first nip N1 in a moving direction of the pressure belt 52 so as to face a pressure plate 523 that presses the pressure belt 52. The details of the pressure plate 523 will be described later. Furthermore, the second projection 586 disposed on the downstream side in the moving direction of the heating belt 51 corresponds to a pressure position of the pressure roller 53. Furthermore, the first and second projections 585 and 586 substantially correspond to the positions of the mount portions 571 and 572 bent toward the side of the support member 57. Reference sign 581*a* illustrated in FIG. 8 denotes projections that are provided on a side surface of the heating base material 581 on the upstream side in the rotational direction of the heating belt 51 so as to retain the heating member 582.

Figure 9:
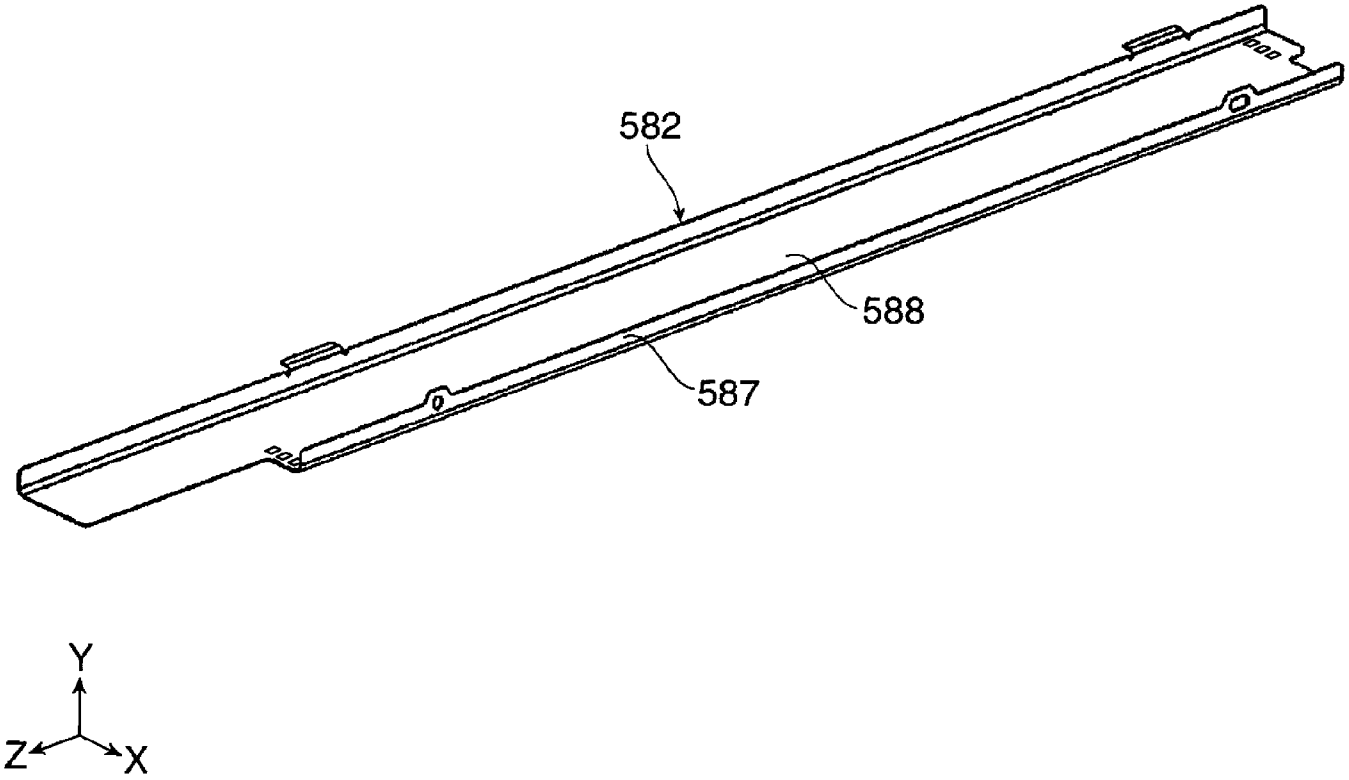
FIG. 9 is a structural perspective view of a heating member.

As illustrated in FIGS. 3 and 9, the heating member 582 includes a sheet-shaped base material 588 and a heating layer 587. The sheet-shaped base material 588 having a thin sheet shape is formed of, for example, metal or heat-resistant synthetic resin having high thermal conductivity. The heating layer 587 is disposed on top of an inner surface of the sheet-shaped base material 588 and includes insulated and uniformly arranged heating wires or heating layers. When power is supplied from a power unit (not illustrated), the heating layer 587 generates heat along a surface in an entirely region of the nips N1 and N2. Both end portions of the sheet-shaped base material 588 in the rotational direction of the heating belt 51 are secured to the support member 57. Furthermore, an end portion of the heating layer 587 on the upstream side in the rotational direction of the heating belt 51 is secured to the heating base material 581.

As illustrated in FIG. 3, a temperature sensor 589 serving as an example of a temperature detection unit is disposed so as to be in contact with an inner surface of the heating member 582 at a downstream end portion of the first nip N1. Power supply to the heating layer 587 of the heating member 582 is controlled in accordance with a detection signal from the temperature sensor 589 by using the controller 200, thereby the temperature of the heating belt 51 is adjusted to the required fixing temperature. Plural fixing temperatures that is required may be set in accordance with types, sizes, and the like of the recording sheets 5. Reference sign 590 illustrated in FIG. 3 indicates signal lines of the temperature sensor 589.

Furthermore, a pressing member 591 having a substantially T shape in section is disposed between the first nip N1 and the second nip N2. The pressing member 591 is formed of a material such as heat-resistant resin or an elastic body such as heat-resistant rubber and supports a rear surface of the heating belt 51.

Figure 10:
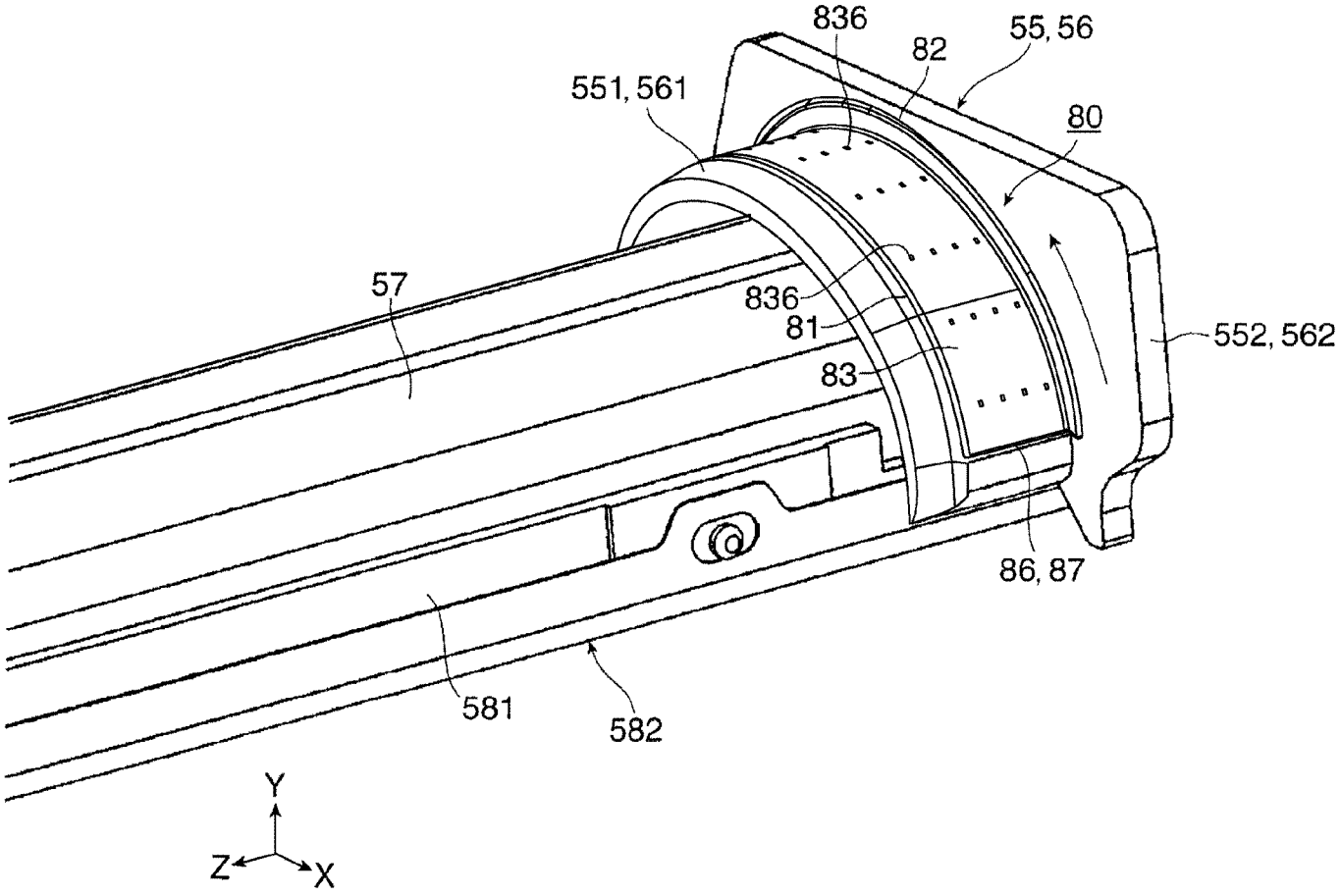
FIG. 10 is a structural perspective view of a belt-end-portion holding member provided at an end portion of the heating belt.

According to the present exemplary embodiment, as illustrated in FIG. 10, a lubricating device 80 for the belt-shaped member that applies a liquid lubricant to the heating belt 51 for lubrication is provided. The lubricating device 80 also functions as a lubricant leakage preventing device that prevents leakage of the liquid lubricant. The lubricating device 80 includes, for example, the pair of belt-end-portion holding members 55 and 56 and an applicator that applies the liquid lubricant to an inner circumferential surface of the heating belt 51. Although reference sign 592 illustrated in FIG. 3 indicates a portion of the heating base material (heating pad) 581, the applicator may be included in the portion 592 of the heating base material 581. Furthermore, the liquid lubricant may be initially applied to the inner circumferential surface of the heating belt 51. When the portion 592 of the heating base material 581 is included in the applicator, the portion 592 of the heating base material 581 is provided over the substantially entire length of the heating belt 51 in the axial direction. The pair of belt-end-portion holding members 55 and 56 each have a first groove 81 and a second groove 82. The first groove 81 extends in the circumferential direction (rotational direction) of the heating belt 51 and holds oil so as to prevent or suppress leakage of the oil. The oil serves as an example of the liquid lubricant applied (supplied) to the inner circumferential surface of the heating belt 51. The second groove 82 extends in the circumferential direction (rotational direction) of the heating belt 51 at a position further to the outside (end portion side) than the first groove 81 in the axial direction of the heating belt 51 and holds the oil so as to prevent or suppress leakage of the oil.

Applicators 592 are formed of, for example, a felt material such as Nomex (trade name). The applicators 592 are impregnated with about 2.0 g of oil as a liquid lubricant containing, for example, amino Si oil having a viscosity of 300 cs. As illustrated in FIG. 3, the applicators 592 are fixedly provided at an upstream end portions of the belt-end-portion holding members 55 and 56 in the rotational direction of the heating belt 51 by, for example, adhesion.

The first groove 81 is provided in each of the holding portions 551 and 561 of the belt-end-portion holding members 55 and 56. Furthermore, the second groove 82 is provided in each of the flange portions 552 and 562 of the belt-end-portion holding members 55 and 56. The first and second grooves 81 and 82 may be directly formed in the holding portions 551 and 561 and the flange portions 552 and 562 of the belt-end-portion holding members 55 and 56. According to the present exemplary embodiment, the first and second grooves 81 and 82 are each configured by a corresponding one of the belt-end-portion holding members 55 and 56 and a groove forming member 83 mounted on this belt-end-portion holding member 55 or 56. An arrow illustrated in FIG. 10 indicates the rotational direction of the heating belt 51.

Figure 11:
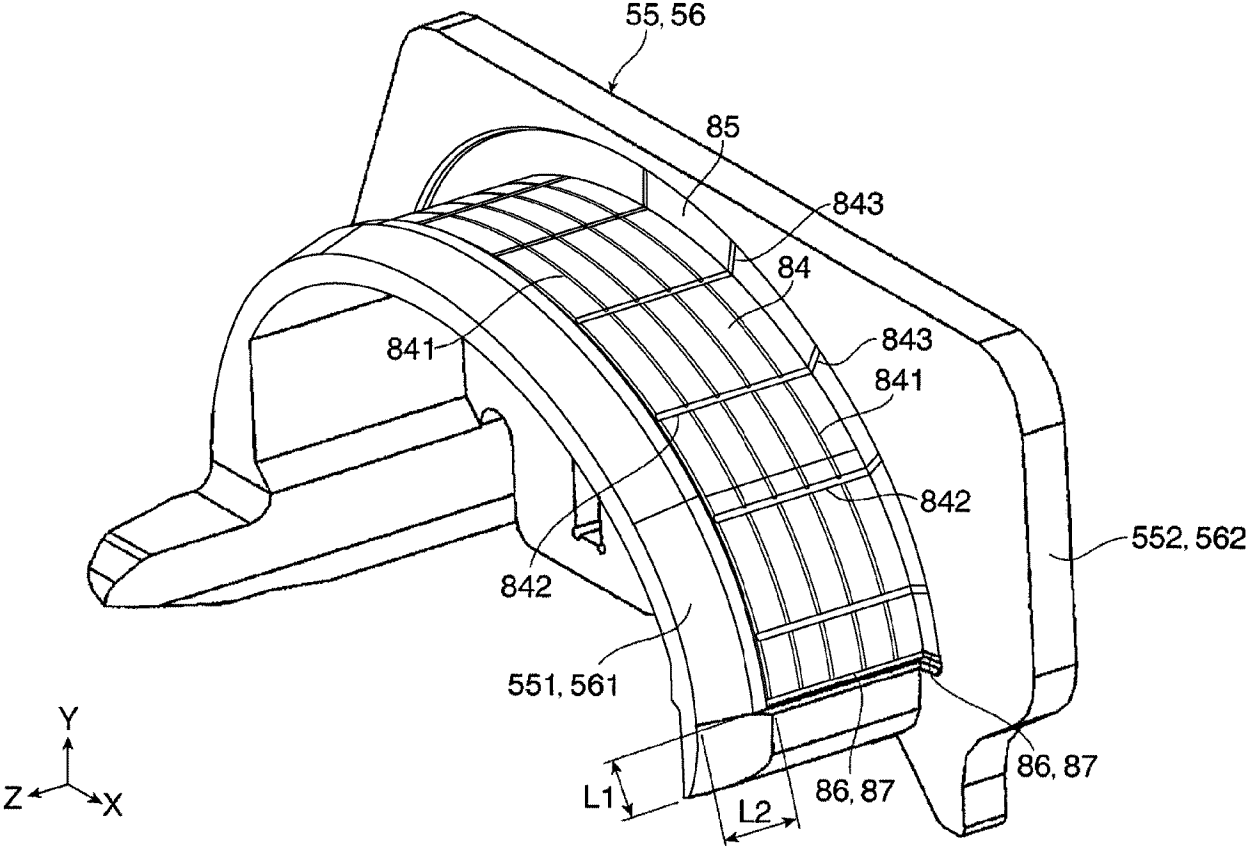
FIG. 11 is a structural perspective view of the belt-end-portion holding member.
Figure 12:
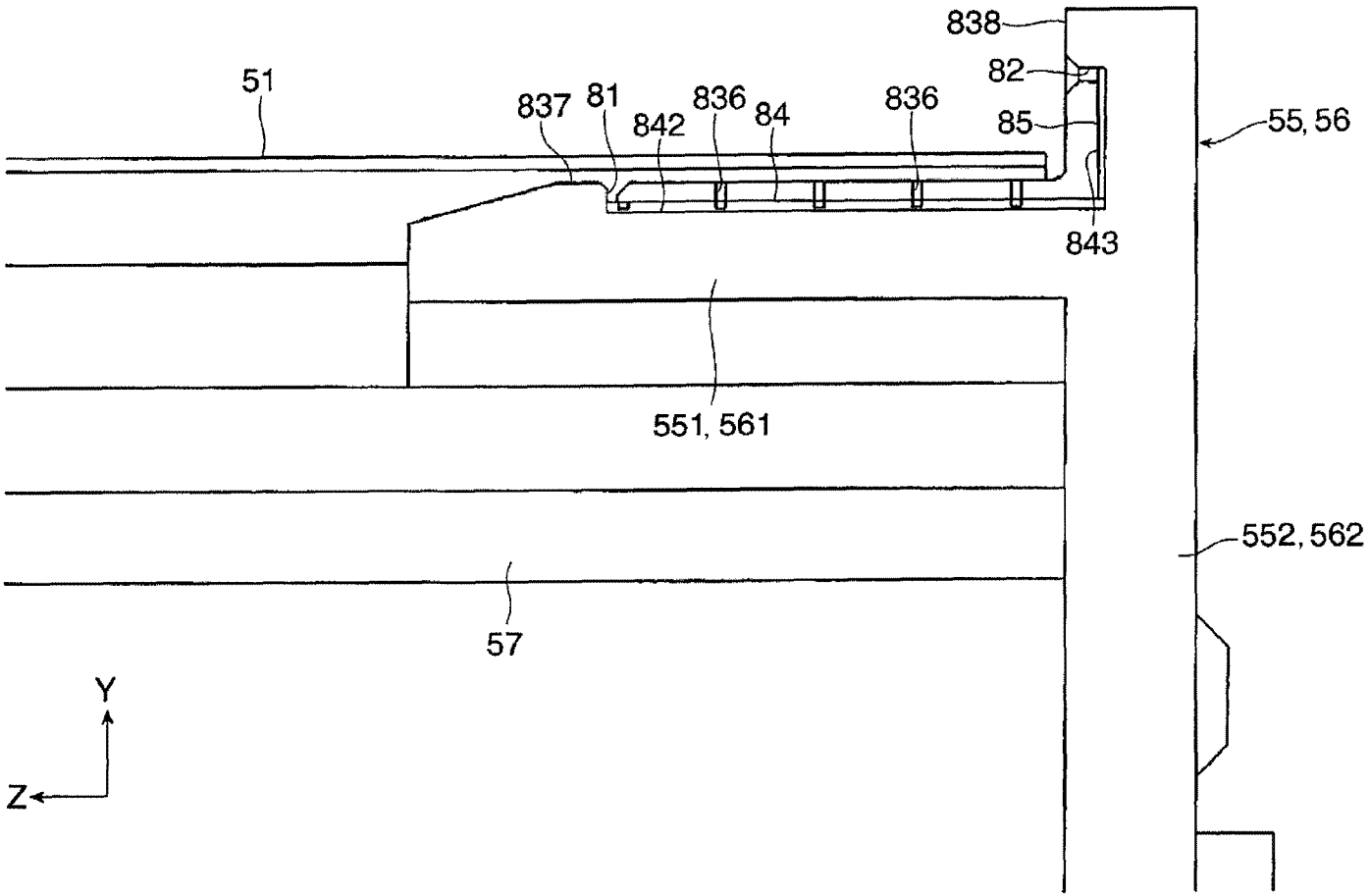
FIG. 12 is a structural sectional view of a belt-end-portion holding member provided at the end portion of the heating belt.

In more detail, as illustrated in FIGS. 11 and 12, each of the belt-end-portion holding members 55 and 56 has shallow recesses 84 and 85 in a region from a corresponding one of the holding portions 551 and 561 to a corresponding one of the flange portions 552 and 562. The recess 84 formed in each of the holding portions 551 and 561 of the belt-end-portion holding members 55 and 56 has a shape that is part of a substantially cylindrical shape in the following range: in the rotational direction of the heating belt 51 held by the holding portions 551 and 561, from a position downstream of an upstream end portion by a required length L1 to a position upstream of a downstream end portion by a required length; and, in the axial direction of the heating belt 51 held by the holding portions 551 and 561, from a position further to the outside than an inner end portion by a required length L2 to the flange portion 552 or 562. Furthermore, the recess 85 formed in each of the flange portions 552 and 562 of the belt-end-portion holding members 55 and 56 has a shape that is part of a substantially annular shape along the radially outer circumference in the following range: in the rotational direction of the heating belt 51, from the position downstream of the upstream end portion by the required length L1 to a position upstream of the downstream end portion by a required length.

Furthermore, first to third passages 841, 842, and 843 that are fine passages are formed in the bottom surface of the recess 84 formed in each of the holding portions 551 and 561 and an inner side surface of the recess 85 formed in each of the flange portions 552 and 562. Oil held by the first and second grooves 81 and 82 is fed to the surface (outer circumferential surface) of each of the groove forming members 83 due to capillarity through the first to third passages 841, 842, and 843. The first passages 841 formed in the bottom surface of the recess 84 have an equal length to the length of the first groove 81 in the circumferential direction of the holding portions 551 and 561. Furthermore, plural first passages 841 are provided so as to be spaced from one another by a required distance in the axial direction of the holding portions 551 and 561. The second passages 842 having a slightly larger depth than that of the first passages 841 are formed in the axial direction of the holding portions 551 and 561. Furthermore, plural second passages 842 are provided so as to be spaced from one another by a required distance in the circumferential direction of the holding portions 551 and 561. Furthermore, the third passages 843 having a substantially the same depth as that of the second passages 842 are formed in the radial directions in the inner side surface of the recess 85 of each of the flange portions 552 and 562 at positions corresponding to the second passages 842. Furthermore, plural third passages 843 are provided so as to be spaced from one another by a required central angle in the circumferential direction of the flange portions 552 and 562.

Figure 13:
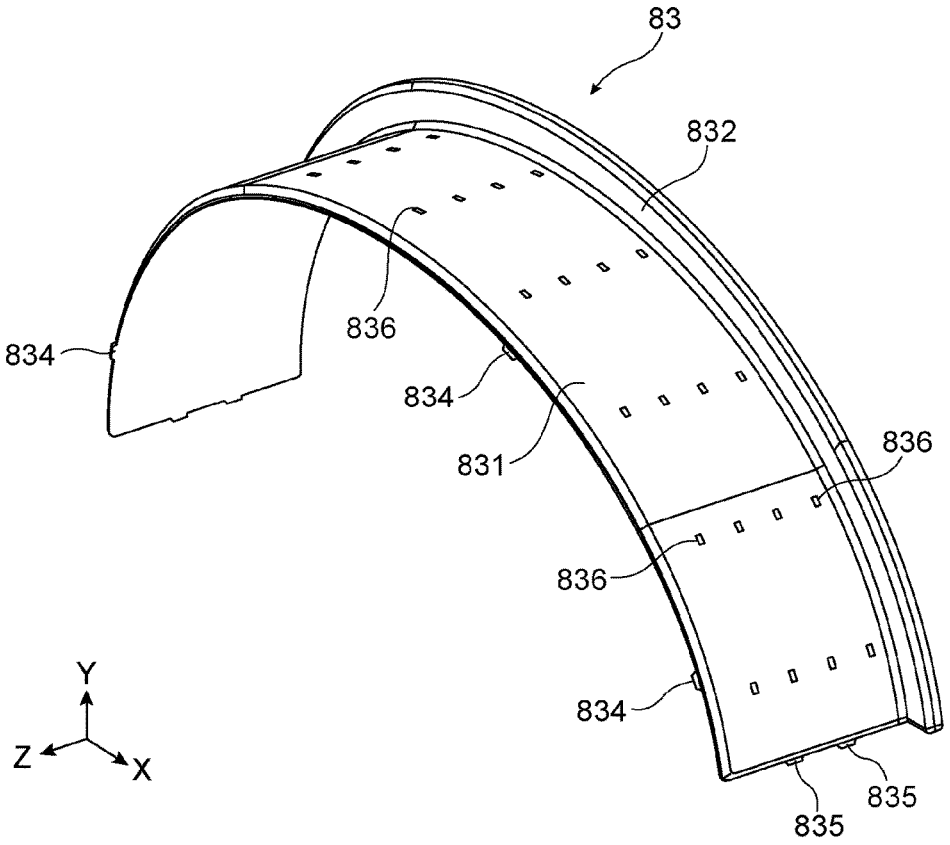
FIG. 13 is a structural perspective view of a groove forming member.

The groove forming member 83 is mounted on the recesses 84 and 85 provided in each of the belt-end-portion holding members 55 and 56 as described above. As illustrated in FIG. 13, the groove forming member 83 has a similar shape to the shape of the recesses 84 and 85 provided in each of the belt-end-portion holding members 55 and 56. The size of the groove forming member 83 is slightly smaller than the size of the recesses 84 and 85. That is, the groove forming member 83 includes a first groove forming portion 831 and a second groove forming portion 832 which are integral with each other. The first groove forming portion 831 has a shape that is part of a substantially cylindrical shape corresponding to the recess 84 formed in each of the holding portions 551 and 561 of the belt-end-portion holding members 55 and 56. The second groove forming portion 832 has a shape that is part of a substantially annular shape corresponding to the recess 85 formed in each of the flange portions 552 and 562 of the belt-end-portion holding members 55 and 56. The first groove forming portion 831 of the groove forming member 83 includes plural nails (projections) 834 and plural nails (projections) 835 at an inner end portion in the axial direction and at both end portions in the circumferential direction, respectively. The plural nails 834 and the plural nails 835 allow the groove forming member 83 to be fixedly mounted by being press fitted into the recess 84 formed in each of the holding portions 551 and 561 of the belt-end-portion holding members 55 and 56. Furthermore, the first groove forming portion 831 has plural communicating holes 836 at positions thereof corresponding to intersecting positions where the first passages 841 intersect the second passages 842 in each of the belt-end-portion holding members 55 and 56. Oil having moved into the recess 84 is moved to the surface of the groove forming member 83 through the communicating holes 836 due to capillarity.

As illustrated in FIGS. 10 and 12, each of the first grooves 81 is formed between a side surface of a corresponding one of the recesses 84 and an end surface of a corresponding one of the groove forming member 83 by mounting the groove forming member 83 on the recess 84 of a corresponding one of the belt-end-portion holding members 55 and 56. Furthermore, each of the second groove 82 is formed between an inner circumferential end surface of a corresponding one of the recesses 85 and an outer circumferential end surface of the a corresponding one of the groove forming members 83 by mounting the groove forming member 83 on the recess 85 of a corresponding one of the belt-end-portion holding members 55 and 56. Edges of the recess 84 of each of the belt-end-portion holding members 55 and 56 and end edges of the groove forming member 83 facing the recess 84 are chamfered, and ends of openings of the first and second grooves 81 and 82 are tapered.

Furthermore, a first step portion 837 is provided at a position closer to the center in the axial direction than the first groove 81. The first step portion 837 projects outward in the radial direction of the belt-end-portion holding members 55 and 56. This may further prevent or suppress leakage of the oil contained in the first groove 81.

Furthermore, a second step portion 838 is provided at a position further from the center in the radial direction than the second groove 82. The second step portion 838 projects inward in the axial direction of the belt-end-portion holding members 55 and 56. This may further prevent or suppress leakage of the oil contained in the second groove 82.

As illustrated in FIGS. 10 and 11, the holding portions 551 and 561 of the belt-end-portion holding members 55 and 56 each have third grooves 86 and 87. The third grooves 86 and 87 are provided in an outer circumferential surface of each of the holding portions 551 and 561 and extend in the axial direction of the heating belt 51 so as to connect the first groove 81 to the second groove 82. The third grooves 86 and 87 include a channel 86 and a channel 87. The channel 86 connects one end portion of the first groove 81 on the upstream side in the circumferential direction to one end portion of the second groove 82 on the upstream side in the circumferential direction. The channel 87 connects the other end portion of the first groove 81 on the downstream side in the circumferential direction to the other end portion of the second groove 82 on the downstream side in the circumferential direction. As is the case with the first and second grooves 81 and 82, the third grooves 86 and 87 are formed by mounting the groove forming members 83 on the recesses 84 of the belt-end-portion holding members 55 and 56.

The holding portions 551 and 561 and the flange portions 552 and 562 of the belt-end-portion holding members 55 and 56 are provided with the first to third grooves 81, 82, 86, and 87 having channel shapes along the outer peripheries of the holding portions 551 and 561.

As described above, according to the present exemplary embodiment, the applicators 592 are provided in the belt-end-portion holding members 55 and 56 so as to apply the oil to the inner circumferential surface of the heating belt 51. However, the applicators 592 may be omitted as long as required amounts of the oil are able to be held in the first to third grooves 81, 82, 86, and 87 and the recesses 84 and 85 of the belt-end-portion holding members 55 and 56.

Furthermore, the inner circumferential surfaces of the groove forming members 83 and the outer side surfaces of the groove forming members 83 in the axial direction are in tight contact with the outer circumferential surfaces and the inner side surfaces of the recesses 84 and 85 of the belt-end-portion holding members 55 and 56.

Referring to FIG. 3, the pressure belt 52 is, as is the case with the heating belt 51, an endless belt formed of a material including, for example, synthetic resin such as, for example, polyimide resin or polyamide resin in which a resistance adjuster or the like such as carbon black is dispersed according to need. The perimeter (the circumferential length in the moving direction) of the pressure belt 52 is set to be smaller than that of the heating belt 51. The pressure belt 52 is rotatably mounted on an outer circumference of a pressure member 521 that causes the pressure belt 52 to be in pressure contact with the heating belt 51 and holds the pressure belt 52 such that the pressure belt 52 is rotatable so as to move in a circular path.

The pressure member 521 is formed of, for example, metal or heat-resistant synthetic resin so as to have a substantially trapezoidal shape in section. An elastic member 522 formed of, for example, heat-resistant rubber is provided on a side surface of the pressure member 521 on the heating belt 51 side. Furthermore, the pressure member 521 is pressed against the heating belt 51 by the pressure plate 523 that is disposed on the rear surface side of the pressure member 521, is formed of a metal sheet, and has a substantially L shape in section. The length of the pressure plate 523 in the axial direction of the pressure belt 52 is set to be longer than that of the pressure belt 52. As indicated by crosshatching in FIG. 3, pressure portions 524 are provided at both end portions of the pressure plate 523 in the longitudinal direction of the pressure plate 523. The pressure portions 524 press the pressure belt 52 using a support member so that the pressure belt 52 is in pressure contact with the heating belt 51. The details of this support member will be described later. The pressure member 521 has a recess 525 into which the pressure plate 523 is inserted so as to directly press the pressure member 521 at a position close to the nip N1.

The pressure roller 53 includes a metal cored bar 531 having a columnar shape and a heat-resistant elastic layer 532 that is coated over an outer circumference of the cored bar 531 and formed of an elastic material. Both ends of the cored bar 531 project from end portions of the pressure roller 53 in the axial direction, so that the cored bar 531 also functions as the rotational shaft. The cored bar 531 is rotated by the drive motor 54 via gears (not illustrated) or the like provided at one end portion of the cored bar 531 in the axial direction of the cored bar 531.

Operation of the Lubricating Device for the Belt-Shaped Member and the Fixing Device The image forming apparatus 1 according to the present exemplary embodiment is controlled by the controller 200. Upon reception of instruction information requesting the full-color image forming operation (printing) from the user interface (not illustrated), the printer driver (not illustrated), or the like, the fixing device 50 is driven along with the start of the image forming operation.

As illustrated in FIG. 3, in the fixing device 50, the pressure roller 53 is rotated by the drive motor 54 and the power is supplied to the heating member 582 of the heating unit 58 so as to heat the heating belt 51. When the pressure roller 53 is rotated, the heating belt 51 and the pressure belt 52 are rotated by being driven by the pressure roller 53 along with the rotation of the pressure roller 53.

Oil O is applied by the applicators 592 to the inner circumferential surface of the heating belt 51, thereby decreasing sliding resistance between the heating belt 51 and the holding portions 551 and 561 of the belt-end-portion holding members 55 and 56.

Accordingly, when the fixing device 50 is continuously used, the oil O supplied to the inner circumferential surface of the heating belt 51 is gradually moved to the inside and outside in the axial direction of the heating belt 51, and forces that causes the oil to leak through gaps with the belt-end-portion holding members 55 and 56 positioned at both the end portions of the heating belt 51 tend to act.

Figure 14:
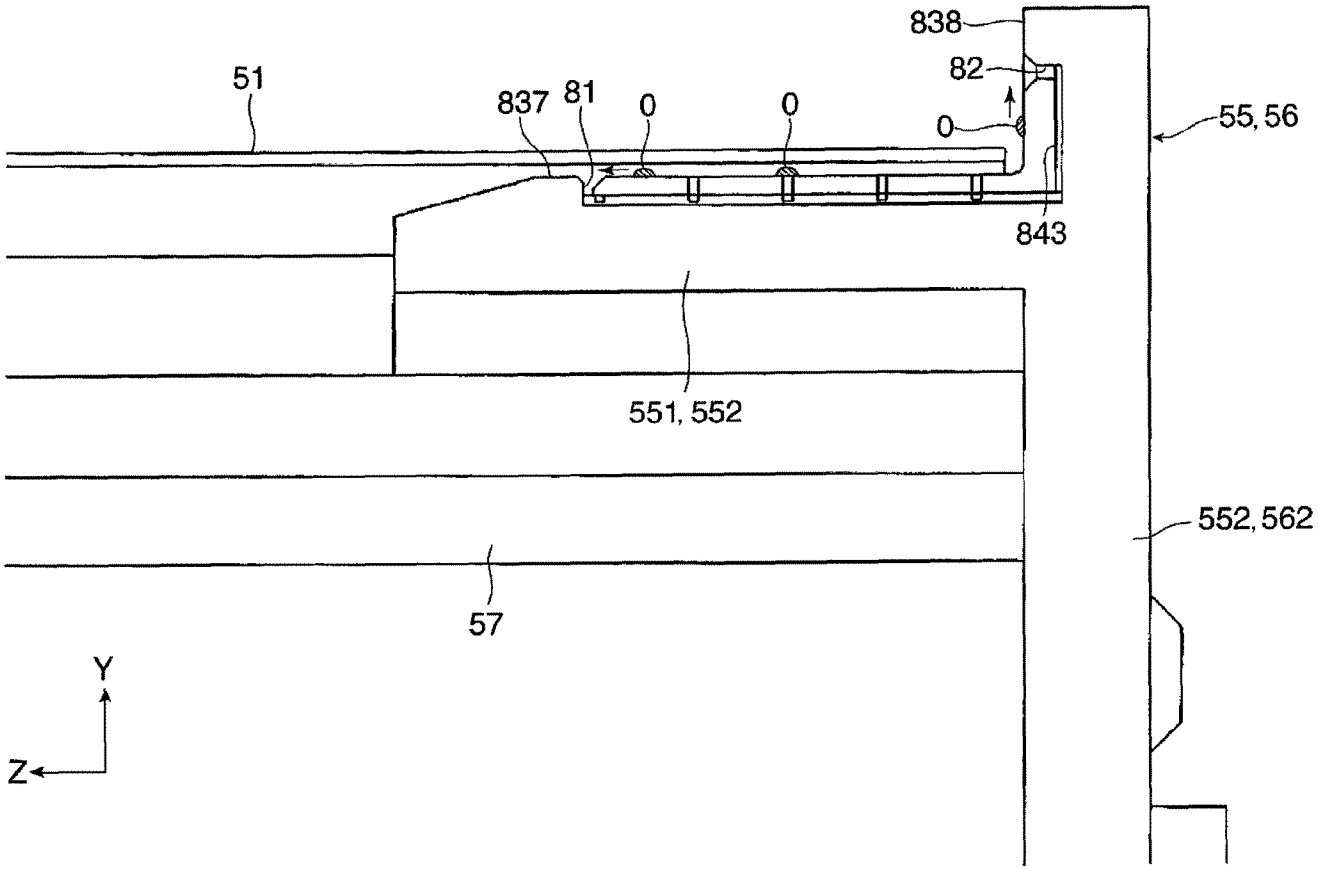
FIG. 14 is a schematic sectional view illustrating action of the fixing device for which a lubricating device for a belt-shaped member according to the exemplary embodiment of the present invention is used.

As illustrated in FIGS. 10 to 12, the belt-end-portion holding members 55 and 56 have the first grooves 81 and the second grooves 82 in the outer circumferential surfaces of the holding portions 551 and 561 and inner side surfaces of the flange portions 552 and 562. With this structure, the oil O having been moved in the axial direction of the heating belt 51 is, as illustrated in FIG. 14, held and contained in the first and the second grooves 81 and 82. Accordingly, when the heating belt 51 is rotated in the required direction, the oil O applied to the inner circumferential surface of the heating belt 51 is held and contained in the first and second grooves 81 and 82. This may prevent or suppress leakage of the oil O through inner and outer end portions in the axial direction of the heating belt 51.

Furthermore, the third grooves 86 and 87 are provided at the end portions in the circumferential direction of the first grooves 81 and the second grooves 82 so as to connect the first grooves 81 to the respective second grooves 82. This may prevent or suppress leakage of the oil O through upstream and downstream end portions in the rotational direction of the heating belt 51.

The oil O held and contained in the first and second grooves 81 and 82 is, as illustrated in FIG. 14, moved due to gravity and capillarity through the first to third passages 841, 842, and 843 provided so as to communicate to the first and second grooves 81 and 82 and is contained in the bottom surfaces and the inner side surfaces of the recesses 84 and 85 provided in the holding portions 551 and 561 and the flange portions 552 and 562 of the belt-end-portion holding members 55 and 56.

The oil O contained in the bottom surfaces and the inner side surfaces of the recesses 84 and 85 is, when the amount of the oil O is increased by a certain degree, moved to the surfaces of the groove forming members 83 also due to capillarity through the plural communicating holes 836 of each of the groove forming members 83. The oil O having been moved to the surfaces of the groove forming members 83 is supplied to and applied again to the inner circumferential surface of the heating belt 51.

As has been described, in the fixing device 50, leakage of the oil O supplied to the inner circumferential surface of the heating belt 51 may be prevented or suppressed. Accordingly, in the fixing device 50, an increase in the sliding resistance with the heating belt 51 caused by an unintentional decrease of the oil O supplied to the inner circumferential surface of the heating belt 51 due to leakage and smearing of the recording sheet 5 with the leaked oil O moving to the front surface of the heating belt 51 may be prevented or suppressed.

Although the image forming apparatus is a full-color image forming apparatus that forms toner images of four colors including yellow (Y), magenta (M), cyan (C), and black (K) according to the above-described exemplary embodiment, techniques described herein are similarly able to be used for an image forming apparatus that forms monochrome images.

Furthermore, although the first and the second grooves 81 and 82 are formed in the belt-end-portion holding members 55 and 56 and the groove forming members 83 according to the above-described exemplary embodiment, the first and second grooves 81 and 82 may be directly formed in the belt-end-portion holding members 55 and 56.

Furthermore, although the techniques described herein are used for the heating belt serving as the belt-shaped member according to the above-described exemplary embodiment, of course, the techniques described herein may be used for the pressure belt, or for both the heating belt and the pressure belt. In so doing, of course, the structures of the heating belt and the pressure belt are not limited to those of the above-described exemplary embodiment.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A lubricating device for a belt-shaped member, the device comprising:

a pair of belt holding members, wherein each of the pair of belt holding members has a corresponding one of outer peripheral surfaces, is disposed at a corresponding one of end portions of the belt-shaped member in an axial direction of the belt-shaped member, and holds the belt-shaped member such that the belt-shaped member is rotatable, wherein the lubricating device has first grooves, wherein each of the first grooves extends in a peripheral direction in the outer peripheral surface of a corresponding one of the pair of belt holding members and holds a liquid lubricant existing on an inner surface of the belt-shaped member, wherein the lubricating device has second grooves, wherein each of the second grooves extends in the peripheral direction, is provided at a position in the outer peripheral surface of a corresponding one of the pair of belt holding members further to an outside than the first groove in the axial direction, and holds the liquid lubricant, wherein the pair of belt holding members include respective flange portions provided at the respective end portions in the axial direction, wherein each of the flange portions projects outward in a radial direction of the belt-shaped member, and wherein the second groove is provided in the flange portion of each of the pair of belt holding members.

2. The lubricating device according to claim 1, further comprising:

first step portions, wherein each of the first step portions is provided at a position further to an inside in the axial direction than a corresponding one of the first grooves and projects outward in a radial direction of the pair of belt holding members.

3. The lubricating device according to claim 1, further comprising:

groove forming members that form the respective first grooves and that have respective end surfaces, wherein each of the pair of belt holding members has an inner side surface and a recess, wherein the recess is provided in the outer peripheral surface of the belt holding member, recessed from the outer peripheral surface, extends in the peripheral direction, and is defined by the inner side surface, and wherein each of the groove forming members is mounted on the recess so as to form the first groove between the inner side surface of the belt holding member and the end surface of the groove forming member.

4. The lubricating device according to claim 2, further comprising:

groove forming members that form the respective first grooves and that have respective end surfaces, wherein each of the pair of belt holding members has an inner side surface and a recess, wherein the recess is provided in the outer peripheral surface of the belt holding member, recessed from the outer peripheral surface, extends in the peripheral direction, and is defined by the inner side surface, and wherein each of the groove forming members is mounted on the recess so as to form the first groove between the inner side surface of the belt holding member and the end surface of the groove forming member.

5. The lubricating device according to claim 1, further comprising:

second step portions, wherein each of the second step portion is provided at a position further to an outside in the radial direction than the second groove and projects inward in the axial direction of the belt-shaped member.

6. A fixing device comprising:

a heating member and a pressure member that are rotatably disposed and that are in pressure contact with each other, and at least one of the heating member and the pressure member is a belt-shaped member having an inner surface; and a lubricating device for the belt-shaped member that holds a liquid lubricant supplied to the inner surface of the at least one of the heating member and the pressure member being the belt-shaped member, wherein the lubricating device is the lubricating device according to claim 1.

7. An image forming apparatus comprising:

an image forming unit that forms an image on a recording medium; and a fixing unit that fixes the image formed on the recording medium by the image forming unit, wherein the fixing unit is the fixing device according to claim 6.

8. A lubricating device for a belt-shaped member, the device comprising:

a pair of belt holding members, wherein each of the pair of belt holding members has a corresponding one of outer peripheral surfaces, is disposed at a corresponding one of end portions of the belt-shaped member in an axial direction of the belt-shaped member, and holds the belt-shaped member such that the belt-shaped member is rotatable, wherein the lubricating device has first grooves, wherein each of the first grooves extends in a peripheral direction in the outer peripheral surface of a corresponding one of the pair of belt holding members and holds a liquid lubricant existing on an inner surface of the belt-shaped member, wherein the lubricating device has second grooves, wherein each of the second grooves extends in the peripheral direction, is provided at a position in the outer peripheral surface of a corresponding one of the pair of belt holding members further to an outside than the first groove in the axial direction, and holds the liquid lubricant, wherein the lubricating device has third grooves, wherein each of the third grooves is provided in the outer peripheral surface of a corresponding one of the pair of belt holding members so as to extend in the axial direction of the belt-shaped member, and wherein the third groove connects the first groove to the second groove.

9. The lubricating device according to claim 8, wherein each of the third groove includes a first channel and a second channel, wherein each of the first grooves has one end and another end in the peripheral direction, and each of the second grooves has one end and another end in the peripheral direction, wherein the one end of the first groove is connected to the one end of the second groove through the first channel, and wherein the other end of the first groove is connected to the other end of the second groove through the second channel.

* * * * *